US009810480B2

(12) United States Patent
Sears et al.

(10) Patent No.: US 9,810,480 B2
(45) Date of Patent: Nov. 7, 2017

(54) METHODS AND APPARATUS FOR ELECTROMAGNETIC PROCESSING OF PHYLLOSILICATE MINERALS

(71) Applicant: Targeted Microwave Solutions Inc., Vancouver (CA)

(72) Inventors: Steve E. Sears, Chesterfield, VA (US); Larry Palmer, Glen Allen, VA (US)

(73) Assignee: Targeted Microwave Solutions Inc., Vancouver, British Columbia (CA)

( * ) Notice: Subject to any disclaimer, the term of this patent is extended or adjusted under 35 U.S.C. 154(b) by 0 days.

(21) Appl. No.: 15/179,826

(22) Filed: Jun. 10, 2016

(65) Prior Publication Data

US 2016/0363369 A1 Dec. 15, 2016

Related U.S. Application Data

(60) Provisional application No. 62/174,763, filed on Jun. 12, 2015.

(51) Int. Cl.
*F26B 17/12* (2006.01)
*F26B 3/347* (2006.01)

(52) U.S. Cl.
CPC ..... *F26B 3/347* (2013.01); *F26B 17/12* (2013.01)

(58) Field of Classification Search
CPC ..... F26B 3/347; F26B 17/12
USPC ..... 34/247
See application file for complete search history.

(56) References Cited

U.S. PATENT DOCUMENTS

| | | | |
|---|---|---|---|
| 3,555,232 | A | 1/1971 | Bleackley |
| 3,631,673 | A | 1/1972 | Charrier et al. |
| 3,849,662 | A | 11/1974 | Blaskowski |
| 4,052,170 | A | 10/1977 | Yan |
| 4,256,944 | A | 3/1981 | Brandon |
| 4,259,560 | A | 3/1981 | Rhodes |
| 4,280,033 | A | 7/1981 | Wagner et al. |
| 4,282,066 | A | 8/1981 | Wagner et al. |
| 4,285,140 | A | 8/1981 | van Raam et al. |
| 4,370,534 | A | 1/1983 | Brandon |
| 4,435,374 | A | 3/1984 | Helm, Jr. |
| 4,466,362 | A | 8/1984 | Maxwell |
| 4,475,922 | A | 10/1984 | Rich |
| 4,488,952 | A | 12/1984 | Soundararajan |
| 4,788,853 | A | 12/1988 | Bell |

(Continued)

FOREIGN PATENT DOCUMENTS

| | | | | |
|---|---|---|---|---|
| CA | 2 908 161 | * | 4/2017 | ..... G01N 23/06 |
| CN | 1914299 | | 2/2007 | |

(Continued)

OTHER PUBLICATIONS

T.P.R. de Jong, et al., "Coal Preparation",coal preparation research, http://www ta.tudeelft.nl/GV/local/CPP/CPPIndex.htm, pp. 1-5.

(Continued)

*Primary Examiner* — Stephen M Gravini
(74) *Attorney, Agent, or Firm* — Todd A. Rattray; Oyen Wiggs Green & Mutala LLP

(57) ABSTRACT

Methods and apparatus for processing phyllosilicate minerals are provided. In some embodiments, the phyllosilicate mineral is clay. In some embodiments, the phyllosilicate mineral is bentonite clay.

18 Claims, 3 Drawing Sheets

(56) References Cited

U.S. PATENT DOCUMENTS

| | | | | |
|---|---|---|---|---|
| 4,805,317 | A * | 2/1989 | Inglis | B01D 53/261 34/259 |
| 4,854,937 | A | 8/1989 | Meyer et al. | |
| 5,123,277 | A * | 6/1992 | Gray | B01D 53/0454 34/80 |
| 5,331,284 | A | 7/1994 | Jean et al. | |
| 5,335,425 | A | 8/1994 | Tomizawa | |
| 5,361,514 | A * | 11/1994 | Lahoda | B09B 3/0091 34/216 |
| 5,393,311 | A | 2/1995 | Marhanka | |
| 5,455,516 | A | 10/1995 | Jean et al. | |
| 5,491,969 | A | 2/1996 | Cohn et al. | |
| 5,567,241 | A | 10/1996 | Tsu et al. | |
| 5,853,579 | A | 12/1998 | Rummler et al. | |
| 5,873,313 | A | 2/1999 | Minami | |
| 5,998,774 | A | 12/1999 | Joines et al. | |
| 6,039,774 | A | 3/2000 | McMullen et al. | |
| 6,087,642 | A | 7/2000 | Joines | |
| 6,109,097 | A | 8/2000 | Conrads et al. | |
| 6,121,594 | A | 9/2000 | Joines et al. | |
| 6,167,636 | B1 | 1/2001 | Kepplinger | |
| 6,265,702 | B1 | 7/2001 | Drozd et al. | |
| 6,386,865 | B1 * | 5/2002 | Suh | A61C 13/0003 264/16 |
| 6,398,921 | B1 | 6/2002 | Moraski | |
| 6,790,547 | B2 | 9/2004 | Dieckmann et al. | |
| 7,161,126 | B2 | 1/2007 | Ripley | |
| 7,191,547 | B2 * | 3/2007 | Wiedl | B01D 53/261 34/264 |
| 7,270,842 | B1 | 9/2007 | Lanier et al. | |
| 7,581,335 | B2 * | 9/2009 | Tanaka | H01L 21/67028 118/900 |
| 7,622,378 | B2 * | 11/2009 | Liu | H01L 21/67034 118/643 |
| 7,665,226 | B2 * | 2/2010 | Tsuruta | A23B 4/015 219/688 |
| 7,666,235 | B2 | 2/2010 | Learey et al. | |
| 7,678,172 | B2 | 3/2010 | Batterham et al. | |
| 8,343,703 | B2 | 5/2013 | Pryzybyla | |
| 8,601,716 | B2 * | 12/2013 | Jerg | A47L 15/481 34/329 |
| 8,839,527 | B2 * | 9/2014 | Ben-Shmuel | D06F 58/266 34/255 |
| 2005/0151294 | A1 * | 7/2005 | Jeong | B29B 15/127 264/165 |
| 2005/0160667 | A1 | 7/2005 | Weinberg et al. | |
| 2005/0236403 | A1 | 10/2005 | Kingman | |
| 2007/0003459 | A1 | 1/2007 | Stadlbauer et al. | |
| 2007/0131591 | A1 | 6/2007 | Pringle | |
| 2007/0151147 | A1 | 7/2007 | Learey et al. | |
| 2007/0158174 | A1 | 7/2007 | Livneh et al. | |
| 2007/0295590 | A1 | 12/2007 | Weinberg et al. | |
| 2008/0048452 | A1 | 2/2008 | Wobben | |
| 2008/0087135 | A1 | 4/2008 | Hwang et al. | |
| 2008/0124253 | A1 | 5/2008 | Schmidt et al. | |
| 2008/0141589 | A1 | 6/2008 | Farneman et al. | |
| 2008/0179177 | A1 | 7/2008 | Cha | |
| 2008/0197013 | A1 | 8/2008 | Cha | |
| 2009/0038213 | A1 | 2/2009 | Weinberg et al. | |
| 2010/0138062 | A1 | 6/2010 | Zheng et al. | |
| 2011/0146544 | A1 | 6/2011 | Yaniv et al. | |
| 2011/0192989 | A1 | 8/2011 | Yaniv et al. | |
| 2012/0138601 | A1 | 6/2012 | Hemmings et al. | |
| 2014/0178513 | A1 * | 6/2014 | Matthews | B29C 47/54 425/6 |
| 2014/0217739 | A1 | 8/2014 | Morgan et al. | |

FOREIGN PATENT DOCUMENTS

| | | | | |
|---|---|---|---|---|
| CN | 101014803 | | 8/2007 | |
| DE | 2907886 | | 9/1980 | |
| DE | 4428418 | | 2/1996 | |
| DE | 10006613 | | 11/2001 | |
| EP | 0252171 | | 1/1988 | |
| EP | 1006080 | | 7/2000 | |
| FR | 2378088 | | 8/1978 | |
| GB | 1092861 | | 11/1967 | |
| GB | 2457493 | | 8/2009 | |
| JP | 54127901 | | 10/1979 | |
| JP | 59049292 | | 3/1984 | |
| JP | 5240061 | | 9/1993 | |
| JP | 09040980 | | 2/1997 | |
| JP | 09176656 | | 7/1997 | |
| JP | 10331609 | | 12/1998 | |
| JP | 11278819 | | 10/1999 | |
| JP | 2000319672 | | 11/2000 | |
| JP | 2011255941 | | 12/2011 | |
| JP | 5496512 | B2 * | 5/2014 | H01L 21/67034 |
| KR | 101291017 | B1 * | 7/2013 | H01L 21/67034 |
| WO | 9707185 | | 2/1997 | |
| WO | 2006013551 | | 2/2006 | |
| WO | 2008155775 | | 12/2008 | |
| WO | 2009010956 | | 1/2009 | |
| WO | WO 2007055849 | A3 * | 5/2009 | H01L 21/67034 |
| WO | 2009153796 | | 12/2009 | |
| WO | 2013130558 | | 3/2013 | |
| WO | 2013112993 | | 8/2013 | |

OTHER PUBLICATIONS

Sui Jian-cai et al., "Factors Influencing Conversion of Pyritic Sulfur in Coal by Microwave Irradiation", Journal of China University of Mining & Technology (English Edition) vol. 15, No. 1, pp. 1-20 (2005).

Uslu, T. et al., "Effect of microwave heating on magnetic separation of pyrite", Colloids and Surfaces A: Physicochem Eng. Aspects 225, pp. 161-167, (2003).

Weng S., "Mossbauer analysis of the microwave desulfurization process of raw coal", J. Appl. Phys. 73(9), pp. 4680-4682, (May 1, 1993).

Jim Donnelly, "Potential Revival of Dry Cleaning of Coal", The Australian Coal Review, (1999).

Marland, S. et al., "Microwave embrittlement and desulphurization of coal", Acta Montanistica Slovaca, 3, pp. 351-355, (1998).

P. Chanis, "Microwave Drying Pulverized Coal", Apr. 30, 1988, p. 52-53.

Zhao et al, "Prospects of Microwave Power in Coal Processing", Coal Conversion, Nov. 30, 1993, p. 35-40.

* cited by examiner

METHODS AND APPARATUS FOR ELECTROMAGNETIC PROCESSING OF PHYLLOSILICATE MINERALS

RELATED APPLICATIONS

This application claims priority from, and the benefit under 35 USC 119(e) of, U.S. application No. 62/174,763 filed 12 Jun 2015. U.S. application Ser. No. 62/174,763 is hereby incorporated herein by reference.

TECHNICAL FIELD

Some embodiments of the present invention relate to methods and apparatus for the processing of phyllosilicate minerals. Some embodiments of the present invention relate to methods and apparatus for drying phyllosilicate minerals. Some embodiments of the present invention relate to methods and apparatus for processing or drying clay.

BACKGROUND

Phyllosilicate minerals such as clay are important industrial materials. As an example, bentonite is one type of clay composed of montmorillonite. Montmorillonite is a clay mineral comprised of stacks of $SiO_4$ tetrahedra sandwiched between two sheets of octahedrally coordinated aluminum, magnesium or iron. Substitution of lower valence ions for some of the higher valence ones in the octahedral sheets creates a negative charge imbalance that traps cations, most often sodium ($Na^+$) or calcium ($Ca^{2+}$), between the stacked sandwiches. The absorption power of various types of bentonite clay is determined by which cation is present and in what amount. Because sodium ions have a larger hydration sphere than calcium ions do, sodium bentonite can absorb more moisture than its calcium counterpart.

Bentonite clay has a number of different uses, for example, it can be used in drilling mud, or used as a binder, absorbent, decolorizing agent, clarifier, or it can be subjected to still other uses. Bentonite clay can be used to produce absorbent products, for example for absorbing chemicals, oil or grease, or for absorbing animal waste, such as in litter for domestic animals such as cats. Cat litter is an important commercial product, and requires a material that can absorb moisture and, preferably, trap odors. Traditional litter materials such as ashes, dirt and sand, and even clays traditionally used as kitty litter that do not clump significantly in the presence of moisture, must be discarded and replaced fairly often. Bentonite clay tends to clump in the presence of moisture, facilitating the removal of soiled litter by removing the clumps of wet bentonite clay created by urine, leaving behind clean litter. Bentonite clay can also sequester urine and trap ammonia ($NH^{4+}$) produced from urine degradation, to help control odors.

In order to be manufactured into absorbent products, phyllosilicate minerals, including clay and including bentonite clay, must generally first be dried. Traditionally, bentonite clay has been dried using conventional thermal systems where heat energy is applied to the outside of the clay particles, warming the clay to a temperature required to evaporate water and dry the clay. This conventional process is inefficient for a number of reasons, including because the clay has excellent insulative properties due to its structure. The clay thus resists the absorption of heat from the outside of the clay particle to the inside of the clay particle.

The drying of phyllosilicate minerals, including clay, can be complicated by the fact that phyllosilicate minerals have properties of agglomeration, which can make such materials more difficult to dry than other bulk materials such as aggregates. There is a need for improved methods and apparatus for drying phyllosilicate minerals, including clay, including bentonite clay.

The foregoing examples of the related art and limitations related thereto are intended to be illustrative and not exclusive. Other limitations of the related art will become apparent to those of skill in the art upon a reading of the specification and a study of the drawings.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

As used in the present specification with reference to an apparatus, the term "inwardly" means in a direction towards the axial centerline of an apparatus. The term "outwardly" means the opposite of inwardly, i.e. in a direction away from the axial centerline of an apparatus. As used in the present specification with reference to a phyllosilicate mineral such as clay, the term "inwardly" means towards the interior of a particle or agglomeration of the phyllosilicate mineral, while the term "outwardly" means towards the surface of a particle or agglomeration of the phyllosilicate mineral.

Some embodiments of the present invention remove water from phyllosilicate minerals without using the phyllosilicate minerals as the medium to transfer the energy required to drive the water from the phyllosilicate minerals. In some embodiments, the phyllosilicate minerals are exposed to electromagnetic energy to dry the phyllosilicate minerals. Without being bound by theory, it is believed that the electromagnetic energy is able to pass through the phyllosilicate minerals and interact with only the water molecules, because the water molecules are polar, and therefore have an electrical dipole moment, while the phyllosilicate mineral is not polar. The interaction between the electromagnetic energy and the water causes the water molecules to resonate. The friction created from this action generates an outward pressure and heat which causes the water molecules to approach the point of phase shift from a liquid to a vapor. Thus, not only thermal processes are used to dry the phyllosilicate mineral, but a mechanical electromotive force is also generated to drive water molecules out of particles of the phyllosilicate mineral.

In some embodiments, the phyllosilicate mineral is exposed to radio frequency (RF) energy. In some embodiments, the phyllosilicate mineral is exposed to microwave energy. In some embodiments, the phyllosilicate mineral is exposed to non-ionizing electromagnetic energy having a frequency in the range of about 300 MHZ to about 300 GHZ.

Figure 1:
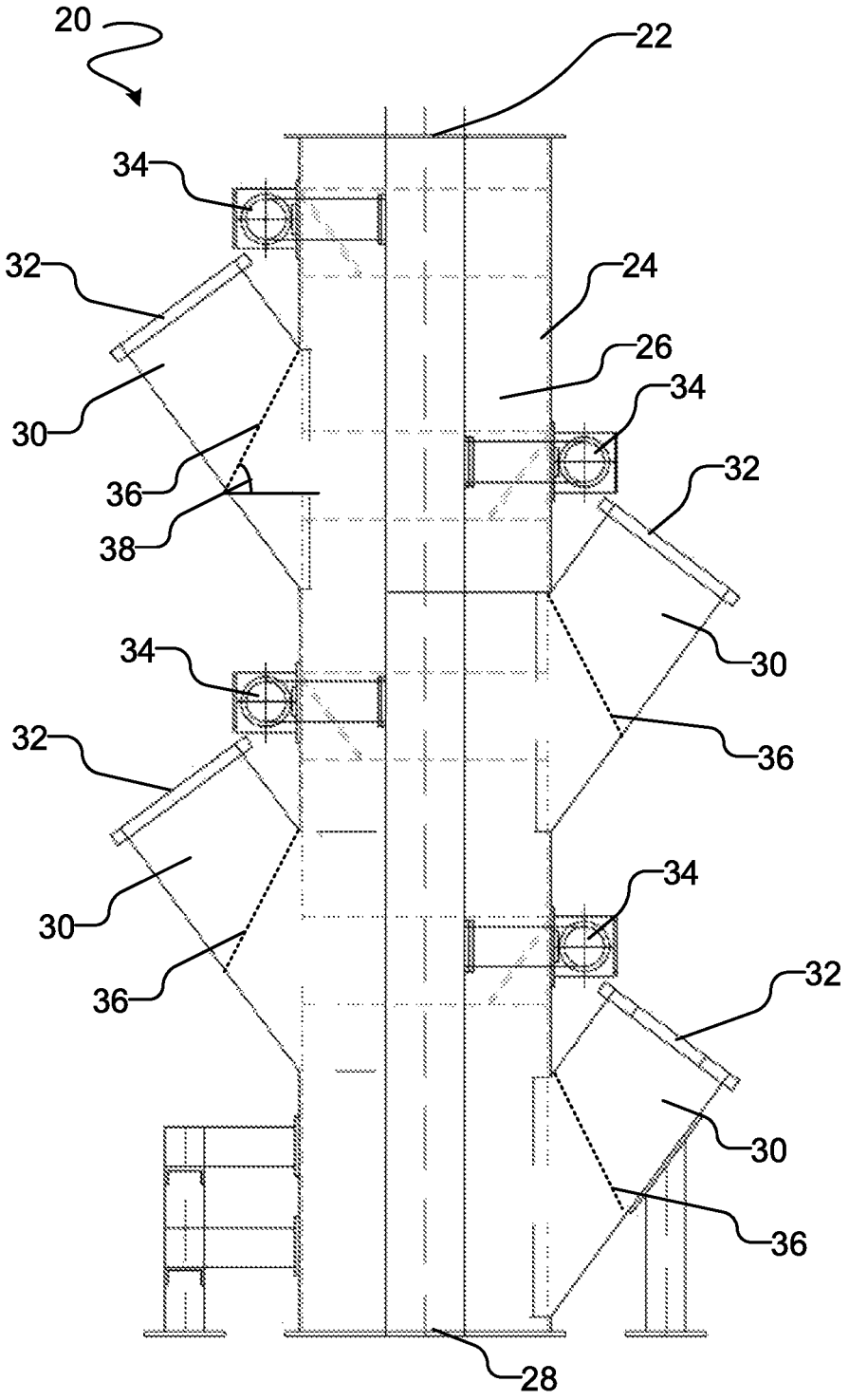
FIG. 1 shows a sectional view of an example embodiment of an apparatus for drying phyllosilicate minerals.

An example embodiment of an apparatus 20 that can be used in some embodiments is illustrated in FIG. 1. Apparatus 20 has an inlet 22 for receiving phyllosilicate mineral to be dried and a main body 24. Main body 24 is a generally vertically extending housing that defines a processing cavity 26, within which the phyllosilicate mineral to be dried is processed. Main body 24 extends generally in a vertical direction, so that the phyllosilicate mineral to be dried is passed in through inlet 22 at or near the top of main body 24, and flows downwardly through processing cavity 26 under the influence of gravity, and is removed from main body 24 through outlet 28 at or near the bottom of main body 24.

Main body 24 can be made from any suitable material, for example steel or steel alloy, and can be sized appropriately based on the anticipated volume of phyllosilicate mineral to be processed.

Electromagnetic energy is supplied to processing cavity 26 via one or more angled housing protrusions 30. The interior of angled housing protrusions 30 is associated with processing cavity 26, so that electromagnetic energy is passed through angled housing protrusions 30 into processing cavity 26.

Electromagnetic energy is supplied to apparatus 20 by any suitable source of electromagnetic energy, for example, a radio frequency or microwave generator such as a magnetron or the like (not shown). Suitable sources of electromagnetic energy are known to those skilled in the art. The power of the source of electromagnetic energy supplied to apparatus 20 can be selected by one skilled in the art based on the volume of processing cavity 26 and the amount of phyllosilicate mineral to be dried. In some example embodiments, the microwave generator used to supply electromagnetic energy to apparatus 20 has a power in the range of 20 to 120 kilowatts of power.

The electromagnetic energy is passed to angled housing protrusions 30 via an electromagnetic energy induction coupling plate 32 positioned at the outside end of each angled housing protrusion 30. In some embodiments, the electromagnetic energy induction coupling plate 32 comprises a flange for connecting a waveguide to main body 24. In some embodiments, the electromagnetic energy induction coupling plate 32 may be made from a steel or steel alloy.

In some embodiments, the angle of angled housing protrusion 30, and/or the location of electromagnetic energy induction coupling plate 32, and/or the rate of flow of phyllosilicate mineral into inlet 22 is selected to avoid having the phyllosilicate mineral being dried contact the energy induction coupling plate. In some embodiments, the position of electromagnetic energy induction coupling plate 32 is selected to be above the highest anticipated point of flow of the phyllosilicate mineral within angled housing protrusions 30 as the phyllosilicate mineral flows downwardly through processing cavity 26.

In some embodiments, the highest anticipated point of flow of the phyllosilicate mineral can be determined based on the expected angle of repose of the phyllosilicate mineral. The angle of repose is the steepest angle at which a material can be piled without slumping (i.e. sliding downwardly), as illustrated schematically by angle 38 in FIG. 1. Dashed line 36 in FIG. 1 illustrates the hypothetical highest anticipated point of flow within angled housing protrusion 30 of the phyllosilicate mineral having an angle of repose as illustrated by angle 38. In some embodiments, the anticipated angle of repose for wet excavated clay is approximately 15 degrees, for example in the range of between 10 degrees and 20 degrees, or any value therebetween, e.g. 11, 12, 13, 14, 16, 18 or 19 degrees. In some embodiments, the anticipated angle of repose for dry pulverized clay is approximately 15 degrees, for example in the range of between 10 degrees and 20 degrees, or any value therebetween, e.g. 11, 12, 13, 14, 16, 18 or 19 degrees.

Moisture is removed from processing cavity 26 by one or more extraction ports 34. In some embodiments, moisture is present in the form of water, and water is removed through extraction ports 34 in liquid and/or vapor form. In some embodiments, reduced pressure, for example a vacuum, is used to pull water through extraction ports 34. In some embodiments, the drying of the phyllosilicate mineral in processing cavity 26 is conducted at ambient barometric pressure, so that the provision of reduced pressure below atmospheric (typically atmospheric pressure is approximately 760 mm Hg, although atmospheric pressure can vary slightly based on geographic location and/or prevailing weather conditions) at extraction ports 34 will extract water from processing cavity 26. In some embodiments, extraction ports 34 are provided with screening and/or grates to allow water to exit processing cavity 26 while retaining the phyllosilicate mineral (and optionally any phyllosilicate mineral dust) inside processing cavity 26.

In use, a phyllosilicate mineral to be dried is introduced into apparatus 20 at inlet 22 until processing cavity 26 is filled with the phyllosilicate mineral. After processing cavity 26 has been filled with phyllosilicate mineral, non-ionizing electromagnetic energy is applied to electromagnetic energy induction coupling plates 32 and passes into processing cavity 26. In some embodiments, the electromagnetic energy creates a mechanical electromotive force to force water out of particles of the phyllosilicate mineral being dried in processing cavity 26.

During drying, the phyllosilicate mineral is moved through processing cavity 26 by the force of gravity. In some embodiments, the phyllosilicate mineral is dried in a continuous process using apparatus 20, i.e. unprocessed phyllosilicate mineral is introduced into processing cavity 26 at approximately the same rate at which dried phyllosilicate mineral exits outlet 28, and is continuously dried as it flows downwardly within processing cavity 26 before being collected at outlet 28.

In some embodiments, the flow of phyllosilicate mineral through processing cavity 26 is manipulated to control the time for which the phyllosilicate mineral is exposed to the non-ionizing electromagnetic energy in order to achieve the desired amount of dewatering. In some embodiments, a controller (not shown) is provided to manipulate the flow of phyllosilicate mineral through processing cavity 26. The controller may regulate the inflow of phyllosilicate mineral to be dried through inlet 22, and/or the outflow of dried phyllosilicate mineral through outlet 28.

For example, reducing the rate of outflow of dried phyllosilicate mineral through outlet 28 may increase the time that the phyllosilicate mineral is exposed to non-ionizing electromagnetic energy, while increasing the rate of outflow of dried phyllosilicate mineral through outlet 28 may decrease the time that the phyllosilicate mineral is exposed to non-ionizing electromagnetic energy. The rate of outflow of dried phyllosilicate mineral through outlet 28 can be controlled in one example embodiment by controlling the size of outlet 28 via the controller, for example by partially opening and/or closing a gate covering or partially covering outlet 28. Conversely, increasing the rate of inflow of phyllosilicate mineral through inlet 22 while not increasing (or not increasing as significantly) the rate of outflow of dried phyllosilicate mineral through outlet 28 may increase the time that the phyllosilicate mineral is exposed to non-ionizing electromagnetic energy, while decreasing the rate of inflow of phyllosilicate mineral through inlet 22 while not decreasing (or decreasing to a lesser extent) the rate of outflow of dried phyllosilicate mineral through outlet 28 may decrease the time that the phyllosilicate mineral is exposed to non-ionizing electromagnetic energy.

Any suitable parameter may be used to regulate the flow of material through processing cavity 26. For example, the level or relative percentage of water present in the phyllosilicate mineral to be dried can be measured, the level or relative percentage of water present in the dried phyllosilicate mineral exiting through outlet 28 can be measured, the level or strength of electromagnetic energy applied to processing cavity 26 can be measured, and/or the volume of processing cavity 26 or the volume of phyllosilicate mineral to be dried fed into processing cavity 26 via inlet 22 can be measured to calculate the anticipated processing time required to dry the phyllosilicate mineral to a predetermined extent, or the like. Any combination of some or all of the foregoing parameters can be used to carry out a predictive analysis to anticipate the processing conditions (e.g. time and strength of electromagnetic energy applied, rate of inflow and/or outflow of phyllosilicate mineral, and the like), and the suitability of the selected processing conditions can be verified by testing the properties, for example moisture content, of the dried phyllosilicate mineral exiting outlet 28. Appropriate analytical instruments and/or indicators or other instrumentation can be installed at any point in apparatus 20 to provide information that can be used to set or refine the conditions under which the phyllosilicate mineral is dried.

Water in liquid and/or vapor form is extracted from processing chamber 26 by extraction ports 34. In some embodiments, a reduced pressure is applied at extraction ports 34 to extract water in liquid and/or vapor form. Dried phyllosilicate mineral exits main body 24 at outlet 28.

In some embodiments, water is displaced from the phyllosilicate mineral during drying in apparatus 20 by a mechanical electromotive force generated by force induced by electromagnetic fields at the interface separating the phyllosilicate mineral and the water. Traditional electromagnetic processes utilize thermal dynamics to heat water molecules within a sample by causing vibration of the water molecules to generate heat. The heat produced by this process can result in a phase shift of the water from liquid to vapor, thereby evaporating water from the sample. In contrast, in some embodiments of the present invention, mechanical electromotive forces are used to mechanically force water out of a particle of a phyllosilicate mineral.

Figure 2:
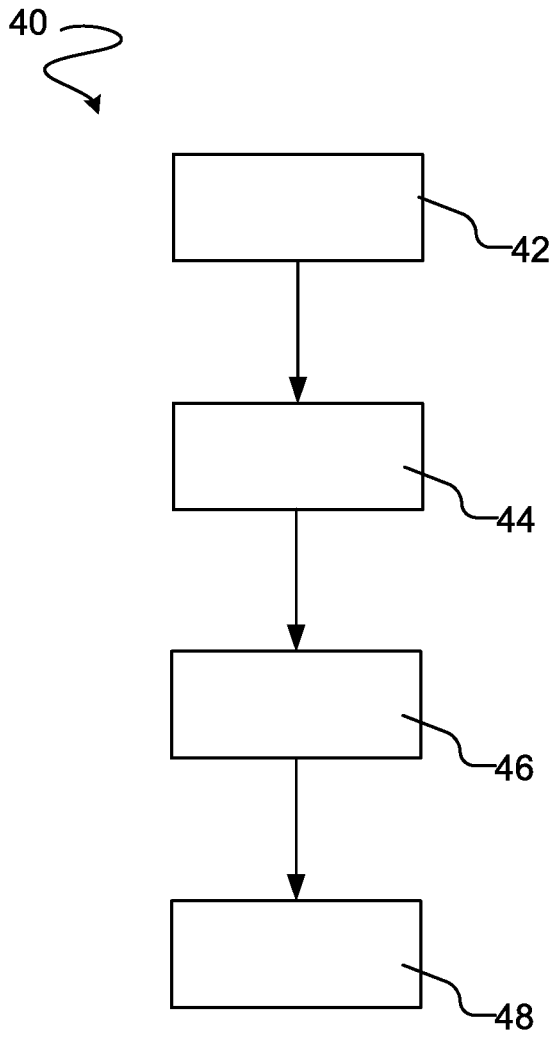
FIG. 2 shows schematically an example embodiment of a method for drying phyllosilicate minerals.

FIG. 2 shows schematically an example embodiment of a method 40 for drying a phyllosilicate mineral. At 42, a raw phyllosilicate mineral is provided to an electromagnetic drying apparatus having a vertically extending processing chamber. At 44, non-ionizing electromagnetic energy is supplied to the vertically extending processing chamber to produce an electromotive force to drive water molecules out of the phyllosilicate mineral. In some embodiments, the non-ionizing electromagnetic energy has a frequency in the range of about 300 MHZ to about 300 GHZ. In some embodiments, the non-ionizing electromagnetic energy is supplied by a generator with a power in the range of 20 to 120 kilowatts.

At 46, water is removed from the vertically extending processing chamber, for example via suitable vents or ports. At 48, the dried phyllosilicate mineral product is removed from the vertically extending processing chamber. In some embodiments, method 40 is carried out at ambient atmospheric pressure. In some embodiments, method 40 is carried out as a continuous process.

In one example embodiment of a method for drying a phyllosilicate mineral, an apparatus having a vertically extending processing chamber, such as apparatus 20 in some such embodiments, is used to dry bentonite clay for the purpose of producing dried bentonite clay suitable for incorporation into an absorbent product such as litter for domestic animals, for example, kitty litter. Excavated bentonite clay from any suitable source is fed into the vertically extending processing chamber via an inlet provided at or near the top of the vertically extending processing chamber. Gravity is used to feed the bentonite clay through the vertically extending processing chamber. Non-ionizing electromagnetic energy having a frequency in the range of about 300 MHZ to about 300 GHZ is provided to the bentonite clay within the vertically extending processing chamber as the bentonite clay flows downwardly within the processing chamber under the influence of gravity. In some embodiments, the non-ionizing electromagnetic energy produces a mechanical electromotive force that drives water molecules out of particles of the bentonite clay. In some embodiments, the bentonite clay is dried in a continuous process.

Dried bentonite clay exits the vertically extending processing chamber via a suitable outlet provided at or near the bottom of the vertically extending processing chamber. The conditions under which the bentonite clay are dried are selected, monitored and/or adjusted to produce dried bentonite clay having a moisture content within a predetermined range as the bentonite clay exits the vertically extending processing chamber. In some embodiments, the moisture content of the dried bentonite clay is in the range of approximately 5% to 7% by weight, including any value therebetween, e.g. 5.5%, 6% or 6.5%. The dried bentonite clay is then subjected to further processing in the same manner as bentonite clay obtained by traditional thermal drying processes to produce the desired product, for example, kitty litter.

Some aspects of embodiments of the present invention are further described with reference to the following examples, which are intended to be illustrative and not limiting in nature.

EXAMPLES

Example 1.0

Calculation of Force Driving Water Molecules out of Phyllosilicate Minerals

The radially outwardly acting electromotive forces applied to the water molecules within particles of phyllosilicate materials can be modelled using Maxwell stress tensor equations. The forces induced by microwave fields are at interfaces separating materials of dissimilar electrical properties. A general expression for these forces, often called Maxwell stresses, is derived from fundamental principles. The expression is then used to calculate the outward force on a region of water embedded in a phyllosilicate mineral particle, where the water and the phyllosilicate mineral have quite different electrical properties.

Example 1.1.1

General Expression of Maxwell Stresses

The Lorentz equation for the force acting on a distribution of charges and currents within a linear, homogeneous, isotropic medium is:

$$F=\int_V[\rho E+J\times B]dV \tag{1}$$

where ρ is the charge density in coulombs/m$^3$ (C/m$^3$), E is the electric field in N/C, J is the current density in A/m$^2$, and B is the magnetic field in N, m$^{-1}$, A$^{-1}$. The field vectors represent the total field due to sources both external and internal to the region of volume V.

From Maxwell's equations, $$J=\nabla\times H-\frac{\partial D}{\partial t} \tag{2}$$

$$\rho=\nabla\cdot D \tag{3}$$

where H is the magnetizing field in A/m and D is the electric displacement field in C/m$^2$.

Substituting Equations (2) and (3) into the bracketed term of Equation (1) and adding the expression $$(\nabla\cdot B)H+\left(\nabla\times E+\frac{\partial B}{\partial t}\right)\times D \tag{4}$$

where H is the magnetizing field in A/m, and where the terms in parenthesis are zero by Maxwell's equations, becomes:

$$F=\int_V[E(\nabla\cdot D)-D\times(\nabla\times E)]dV+\int_V[H(\nabla\cdot B)-B\times(\nabla\times H)]dV-\int_V\mu\varepsilon\frac{\partial}{\partial t}(E\times H)dV \tag{5}$$

With further manipulation, the first two terms of Equation (5) may be expressed as integrals over the surface S that encloses the volume V as:

$$F=\oint_S\left[\varepsilon E(E\cdot\hat{n})-\frac{\varepsilon}{2}E^2\hat{n}\right]dS+\oint_S\left[\mu H(H\cdot\hat{n})-\frac{\mu}{2}H^2\hat{n}\right]dS-\int_V\mu\varepsilon\frac{\partial}{\partial t}(E\times H)dV \tag{6}$$

where $\hat{n}$ is a unit vector normal to S and μ is the magnetic permeability of the medium.

If the surface S encloses the interface between two materials of permittivity $\epsilon_1$ and $\epsilon_2$, where the surface has a vanishingly small width Δx separating a unit area on each side of the interface, the force per-unit-area due to electric field components normal to the interface is $$f_n=\frac{1}{2}(\varepsilon_2E_{2n}^2-\varepsilon_1E_{1n}^2)\hat{x} \tag{7}$$

where $\hat{x}$ is a unit vector along the x-axis. When the boundary condition $\epsilon_1E_{1n}=\epsilon_2E_{2n}$ is applied, $$f_n=\frac{1}{2}(\varepsilon_1-\varepsilon_2)E_{1n}E_{2n}\hat{x} \tag{8}$$

In a similar manner, if electric field components are tangent to the interface, the force per unit area is $$f_t=\frac{1}{2}(\varepsilon_1E_{1t}^2-\varepsilon_2E_{2t}^2)\hat{x} \tag{9}$$

and, setting $E_{1t}=E_{2t}$, $$f_t=\frac{1}{2}(\varepsilon_1-\varepsilon_2)E_{1t}E_{2t}\hat{x} \tag{10}$$

Thus, for both normal and tangential orientations of the electric field, Equations (8) and (10) show that the induced force is always directed across the interface from the region of higher permittivity to the region of lower permittivity, regardless of field polarity.

The force per unit area at a conductor-dielectric interface may be determined from Equation (7) by taking medium 1 to be a good conductor, so that $E_{n1}=0$, and $$f_n=\frac{1}{2}\varepsilon_2E_{2n}^2\hat{x} \tag{11}$$

Hence, the force is directed across the interface from the conductor to the dielectric.

Since the second term of Equation (6) is identical to the first term if E replaces H and $\epsilon$ replaces μ, this replacement can be made in Equations (8) and (10) to find the force per unit area caused by the magnetic field intensity. The last term of Equation (6) can also be ignored in this case, since its magnitude is much less than that of the first term, and since the force described by this last term changes direction at twice the frequency of the propagating wave.

Example 1.1.2

Maxwell Stresses Acting on Water in Phyllosilicate Minerals

The electric field forces represented by Equations (8) and (10) will act to move moisture out of the phyllosilicate mineral by creating an outward force on the moisture, since water and phyllosilicate mineral have different electrical properties. Taking the moisture or water to have a permittivity of $\epsilon_1=75_{\epsilon 0}$, and the phyllosilicate mineral to have a permittivity of $\epsilon_2=4_{\epsilon 0}$ where $\epsilon_0$ is the permittivity of vacuum, the force due to an electric field normal to the interfaces acts to move water out of the phyllosilicate mineral and is, from Equation (8), $$f=\frac{1}{2}\varepsilon_1\left(\frac{\varepsilon_1}{\varepsilon_2}-1\right)E_{in}^2=1.60\times10^{-2}P_i\ \text{dynes/cm}^2 \tag{12}$$

where $P_i = E_{in}^2\sqrt{\epsilon_1/\mu}$ is the peak incident power density ($W/cm^2$) in the phyllosilicate mineral, and a dyne is the force required to give one gram of mass an acceleration of one centimeter per second per second. Thus, for 100 $W/cm^2$ peak power density in the phyllosilicate mineral, the outward force induced on the water surface is 1.60 $dynes/cm^2$.

Example 2.0

Characterization of Microwave-Induced Vibration and Sounds in a Stripline Model

The displacement of material interfaces by the electric field forces described above was demonstrated in the laboratory by applying pulsed microwaves to an air-filled stripline with nylon screws supporting the central conductor between ground planes. A stripline uses a central conductor sandwiched between two parallel ground planes. In this example, air is provided in the stripline rather than a substrate to allow the central conductor to move in response to mechanical electromotive forces. This experiment was conducted to demonstrate that mechanical electromotive forces can be generated in two materials having different dielectric properties based on the principles relating to Maxwell stresses discussed in Example 1.0.

Figure 3:
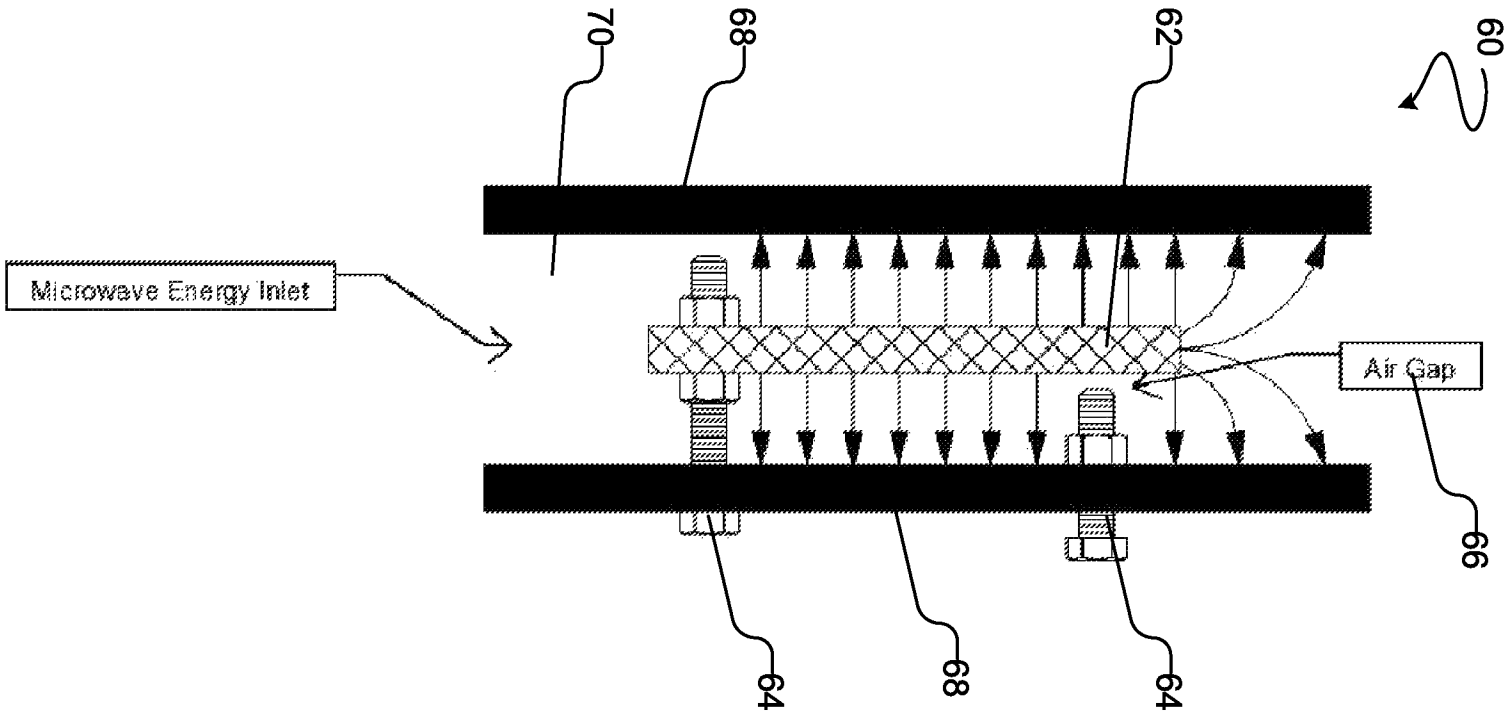
FIG. 3 shows an example embodiment of a dielectric differential stripline model.

A schematic illustration of the apparatus 60 used to conduct these experiments is shown in FIG. 3. For the central plane conductor 62 to vibrate enough to produce audible sounds, it was necessary that one of the nylon screws 64 be loosened slightly to create an air-gap 66 between the central conductor and the flat tip of the screw. This left the central conductor free to vibrate within the air-gap, as the electric field forces acted to pull the nylon screw and the central conductor together during the microwave pulse. The volume between the two parallel ground planes 68 was filled with air 70. From the electrical properties and dimensions of the relevant materials, the forces $f_1$ and $f_0$ (i.e. the sinusoidal change in force acting on conductor 62 as the energy wave passes, thereby causing conductor 62 to vibrate) acting to pull the nylon screw 64 and the conductor 62 together are $f_1 = 8.4\times10^{-4}\ P_i$ $dynes/cm^2$ and $f_0 = 1.34\times10^{-2}\ P_i$ $dynes/cm^2$.

To test the hypothesis that Maxwell stresses (i.e. a mechanical electromotive force) can be induced in the stripline model, 50 μs pulses of microwave energy at 1 GHz were fed into the stripline at the rate of 1000 pulses per second. Sounds were generated in the stripline during the application of microwave energy and were clearly audible anywhere within a large room for a peak incident power as low as 10 $W/cm^2$, yielding $f_1 = 0.008$ $dynes/cm^2$ and $f_0 = 0.0134$ $dynes/cm^2$. The intensity and pitch of the sounds were found to be a function of the peak power and pulse repetition rate of the microwave energy. These findings in the stripline model demonstrate that mechanical electromotive forces can be generated by exposing materials having different dielectric properties to electromagnetic energy. One skilled in the art could soundly predict that similar mechanical electromotive forces would be induced at the interface between water and phyllosilicate mineral.

While a number of exemplary aspects and embodiments are discussed herein, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

What is claimed is:

1. An apparatus for drying a phyllosilicate mineral, the apparatus comprising:
- a vertically extending housing defining a drying chamber;
- an inlet proximate the top of the housing for receiving phyllosilicate mineral to be dried;
- at least one angled protrusion extending from the housing, the angled protrusion comprising an electromagnetic energy induction coupling plate for transferring electromagnetic energy from a source of electromagnetic energy to the drying chamber; and
- an outlet proximate the bottom of the housing for passing dried phyllosilicate mineral out of the drying chamber.

2. An apparatus according to claim 1, further comprising at least one water extraction port.

3. An apparatus according to claim 2, wherein the source of electromagnetic energy is configured to provide electromagnetic energy that generates a mechanical electromotive force to drive water out of the phyllosilicate mineral.

4. An apparatus according to claim 3, wherein the mechanical electromotive force acting on the water is 1.60 $dynes/cm^2$ when the electromagnetic energy is provided at a peak power density of approximately 100 $W/cm^2$.

5. An apparatus according to claim 4, wherein the source of electromagnetic energy comprises a source of non-ionizing electromagnetic energy has a frequency in the range of about 300 MHZ to about 300 GHZ.

6. An apparatus according to claim 5, wherein the source of electromagnetic energy comprises a source of microwaves.

7. A method of drying a phyllosilicate mineral, the method comprising the steps of:
- introducing the phyllosilicate mineral to be dried at an upper portion of a vertical drying chamber;
- filling the drying chamber with the phyllosilicate mineral to be dried;
- exposing the phyllosilicate mineral to be dried to non-ionizing electromagnetic energy to dewater the phyllosilicate mineral; and
- passing dried phyllosilicate mineral through an outlet at a lower portion of the vertical drying chamber.

8. A method according to claim 7, comprising extracting water from the drying chamber through at least one water extraction port during the step of exposing the phyllosilicate mineral to be dried to non-ionizing electromagnetic energy.

9. A method of drying a phyllosilicate mineral, the method comprising the steps of:
- placing the phyllosilicate mineral to be dried in an upper portion of a vertically extending housing;
- passing non-ionizing electromagnetic energy through the phyllosilicate mineral to generate a mechanical electromotive force to drive water out of the phyllosilicate mineral;
- removing the water from the housing; and
- passing dried phyllosilicate mineral from an outlet in a lower portion of the housing.

10. A method according to claim 9, wherein the non-ionizing electromagnetic energy has a frequency in the range of about 300 MHZ to about 300 GHZ.

11. A method according to claim 10, wherein the mechanical electromotive force driving water out of the phyllosilicate mineral is 1.60 $dynes/cm^2$ when the electromagnetic energy is provided at a peak power density of approximately 100 $W/cm^2$.

12. A method according to claim 11, wherein the non-ionizing electromagnetic energy comprises microwaves.

13. An apparatus according to claim 1 wherein the phyllosilicate mineral comprises clay.

14. An apparatus according to claim 1 wherein the phyllosilicate mineral comprises bentonite clay.

15. A method according to claim 7 wherein the phyllosilicate mineral comprises clay.

16. A method according to claim 7 wherein the phyllosilicate mineral comprises bentonite clay.

17. A method according to claim 9 wherein the phyllosilicate mineral comprises clay.

18. A method according to claim 9 wherein the phyllosilicate mineral comprises bentonite clay.

* * * * *